United States Patent [19]

Herrmann

[11] 4,014,198

[45] Mar. 29, 1977

[54] DRIVE MECHANISM OF A PAIR OF FORGING OR STRETCHING ROLLERS

[75] Inventor: Karl-Heinz Herrmann, Coburg, Germany

[73] Assignee: Langenstein & Schemann Aktiengesellschaft, Coburg, Germany

[22] Filed: Jan. 12, 1976

[21] Appl. No.: 648,020

[30] Foreign Application Priority Data

Jan. 10, 1975 Germany ..... 2500756

[52] U.S. Cl. ..... 72/249; 60/413; 60/445; 60/468; 60/489

[51] Int. Cl.[2] ..... B21B 35/00

[58] Field of Search ..... 100/47, 172; 60/413, 60/445, 465, 487, 493, 468, 489; 72/91, 93, 199, 249

[56] References Cited

UNITED STATES PATENTS

| | | | |
|---|---|---|---|
| 1,767,788 | 6/1930 | Francis | 100/172 |
| 2,365,748 | 12/1944 | Curtis | 60/380 |
| 2,467,508 | 4/1949 | Trautman | 60/465 |
| 2,554,381 | 5/1951 | Patterson | 60/413 |
| 2,983,226 | 5/1961 | Livermore | 60/468 X |
| 3,736,753 | 6/1973 | Roth | 60/489 |

*Primary Examiner*—Edgar W. Geoghegan
*Attorney, Agent, or Firm*—Holman & Stern

[57] ABSTRACT

A drive mechanism for a pair of forging or stretching rollers comprising a hydraulic system including a pump, a hydraulic motor and switching means interposed between a main drive motor and the rollers.

5 Claims, 3 Drawing Figures

DRIVE MECHANISM OF A PAIR OF FORGING OR STRETCHING ROLLERS

BACKGROUND OF THE INVENTION

The present invention concerns an actuating or drive mechanism of a pair of forging or stretching rollers with rolling embossments in segmental form, in which a main motor is connectable with the drive shaft of one of the two rollers by means of an intermediately oriented apparatus and wherein a repeated on- and off-switching of the intermediately-oriented apparatus is proposed.

The workpiece for drop-forging comprises sections of round or quadrangularly-rolled steel, whereby these sections are relatively short pieces, which are separated from the rolled steel rods by billet shears or circular saws. These sections are heated and placed into the drop-embossings of the forging hammers or forging presses and are rolled into their final form. Round forged sections, for example, can easily be rolled out of the billet sections, since a round drop form is filled comparatively easily. However, when forged portions with uneven mass-distribution, such as, for example, piston rods, crank shafts, or levers with large mass-concentrations are to be forged, the billet section should be pre-stretched. The pre-stretching will produce a mass-distribution as will be required for drop-embossing.

The pre-stretching may be accomplished by means of stretching or forging-rollers. These stretching- or forging-rollers are a special form of forging machines and differ from normal forging machines by their short work cycle since each working phase requires only one or one-half of a rotation of the rollers. On the rollers are mounted segments with roll-embossments from which are made the required mass distribution. It is important to note that after a completed cycle of one or one-half of the rotation, the roller-segments which are mounted on the rolls return to their starting position.

In a prior art drive mechanism which is presently on the market, the electro-motor actuates a flywheel by means of cone- or V-belts. A single-disc friction-clutch coupling is connected to the flywheel. This coupling is operated by means of compressed air, and is mounted between the flywheel and a drive-shaft. The same shaft carries at its other end a brake means which is also operated by means of compressed air. The propulsive output is transmitted to the shaft of a second roller by means of an intermediate gearing. Since the switching of the coupling and the brake means must be made rapidly, the coupling and brake means are pneumatically operated. The releasing and braking must be adjusted in a manner so that the initial, or starting position of the roller-segments is always obtained. A small pre- and after-run, however, can thereby never be prevented since each embossing requires a different reformability and a different amount of energy is taken from the drive-motor and the flywheel upon each cycle.

Disadvantageously, the prior art drive mechanism requires a belt drive and compressed air connection to a compressor-means. Furthermore, there is also required a coupling means which, due to the rapid cycling of the mechanism, is subjected to a great amount of wear. Since the brake means must stop the entire installation after each working phase, the brake is also subjected to an extremely high use. Additionally, the required reduction of the rotational speed of the main motor, if made via a gearing system, effects an increase in the rotating working load of the motor.

The prior art stretch-forging mechanisms are manufactured in graduated sizes of construction. Each size of construction and design speed of rotation is based on the largest cross-sectional piece to be machined. The speed of rotation of the stretching rollers depends always on the largest cross-sectional piece to be stretched. A workpiece of 45 mm bar must, for example, be stretched on the structure-size mechanism for up to 55 mm, and thereby also with the speed of rotation of the structure size mechanism for up to 55 mm which has a lower speed of rotation compared to the structure size mechanism for 40 mm, since this is covered for a maximum of 55 mm. Since in the prior art stretching roller mechanism it is impossible to work with the maximum speed of rotation for each cross-sectional size of the basic material to be stretched, the prior art stretching-roller machines have a disadvantageous grade of efficiency, in as much as they function with compressed air which is always operating with a low level of efficiency.

It is an object of the present invention to provide for a drive mechanism of the above-descrbied type, in which a high percentage of operating time is not necessarily connected with an extremely high wear rate of a coupling and a brake means, and wherein the power transmission between the main motor and the drive-shaft is simplified. The present invention also provides for an actuating mechanism of the above-described type which is more economical than the prior art actuators. For each cross-sectional size of the basic material to be stretched, the maximum speed of rotation, i.e., the optimal speed of rotation for that size, is obtainable.

It is known in the prior art (see German Pat. Nos. 406,567; 529,872; German publication Nos. 1,138,367; 1,652,976; and 2,152,726), to interarrange in rolling machines a device between a drive-shaft and a main motor, which device being in the form of a hydraulic-acutating or drive mechanism, includes a hydraulic pump and a hydraulic motor. In these cases, the rolling machines are, however, not those which have stretching or forging rollers with a high percentage of operating time, which are a specialty of the rolling-machines, resulting from the many short work cycles.

The present invention provides for a drive mechanism of the above-mentioned type which is characterized in that a hydraulic drive-mechanism is utilized as an intermediately-arranged device, and in that a continuous adjustment of the speed of rotation of the rollers is provided, whereby the main motor drives a hydraulic pump which is connected with a hydraulic motor via a valve- or slide-valve-gear, whereby said hydraulic motor engages the drive shaft.

The transmission of energy from the main motor, which is in most cases an electric motor, is made by means of the hydraulic pump, which is driven by the main motor, via a pipe-connection to the fluid-motor. By switching off the pressure fluid which flows to the fluid-motor, the same will come to an immediate halt. It is therefore possible to stop the flow of pressure fluid by means of the slide-valve or valve gear, so that the rollers are placed precisely into their starting position. The rollers are synchronized, for example, as in the prior art stretching rollers, by means of roller-frame wheels. Compared with the prior art stretching roller drive mechanism, the instant inventive mechanism requires only an electrical connection, since the pneumatically-activated coupling and brake means are not required and therewith also the compressed-air connection to a compressor device is not needed. Also the reduction of the speed of rotation from the main motor which is required in the prior art stretching roller drives, is not required in the inventive apparatus since the main motor is coupled directly to the hydraulic pump.

The continuous adjustment of the speed of rotation is important to the inventive mechanism, since only one energy medium. i.e., hydraulic fluid, is necessary; for each cross-sectional size the maximum speed of rotation can be used and therewith the degree of efficiency and the economic aspects of the operation of the mechanism can be substantially improved. Auxiliary brake means as well as a flywheel are also not required.

BRIEF DESCRIPTION OF THE DRAWINGS

The drawings show a preferred embodiment of the present invention, wherein.

DETAILED DESCRIPTION OF THE INVENTION

Figure 1:
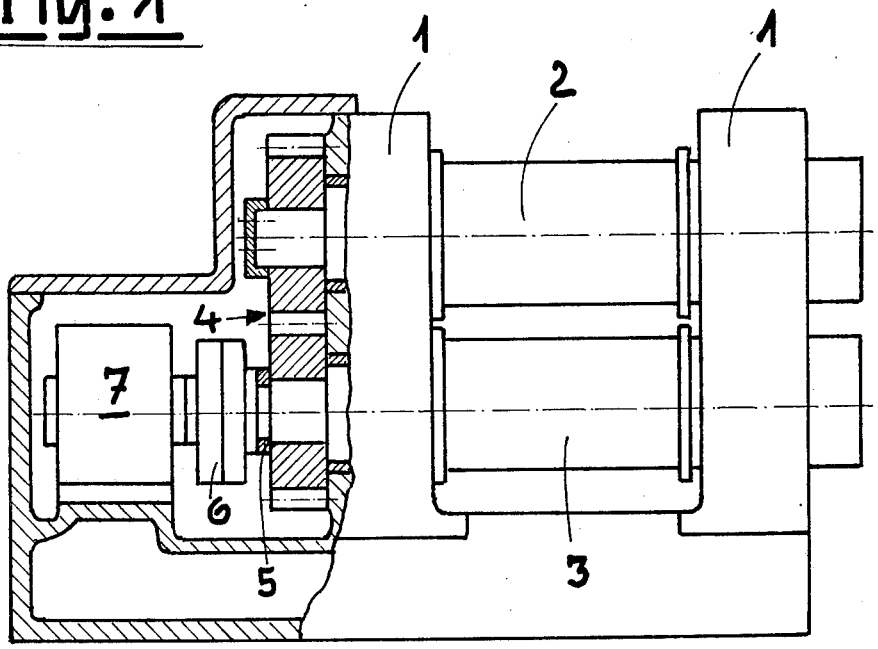
FIG. 1 shows a front-elevational view of a drive mechanism of a pair of forging or stretching rollers, in partial section.
Figure 2:
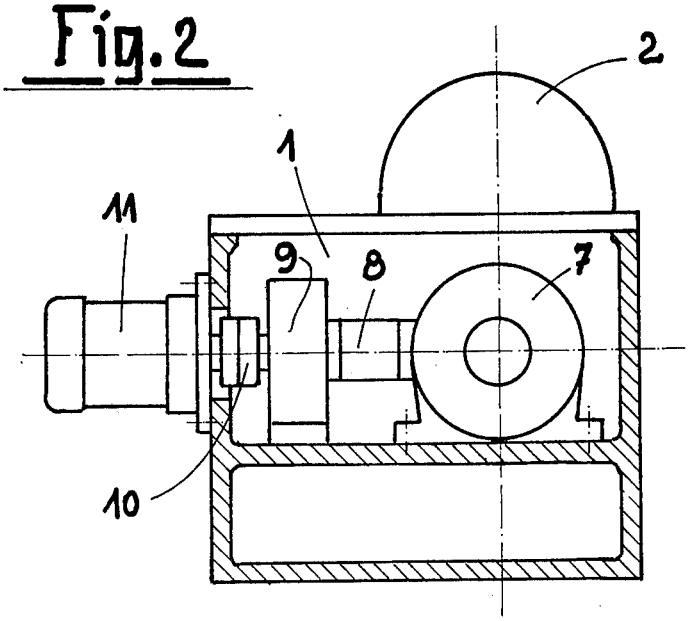
FIG. 2 shows a side-elevational view of the drive mechanism according to FIG. 1, in partial section.

According to FIGS. 1 and 2, two rollers 2,3 are positioned in two roller frames 1 in rotational alignment one above the other, which rollers are provided with rolling embossments (not shown). The upper roller 2 is driven from the lower roller 3 by means of roller frame wheels 4. A drive shaft 5 of the lower roller 3 is fixedly connected with the shaft of a hydraulic motor 7 via a section 6, the hydraulic motor being supplied by a hydraulic pump 9 via a valve- or slide-valve-gear 8. The pump 9 is fixedly connected via a section 10 with the shaft of a main motor 11 which is an electric motor.

Figure 3:
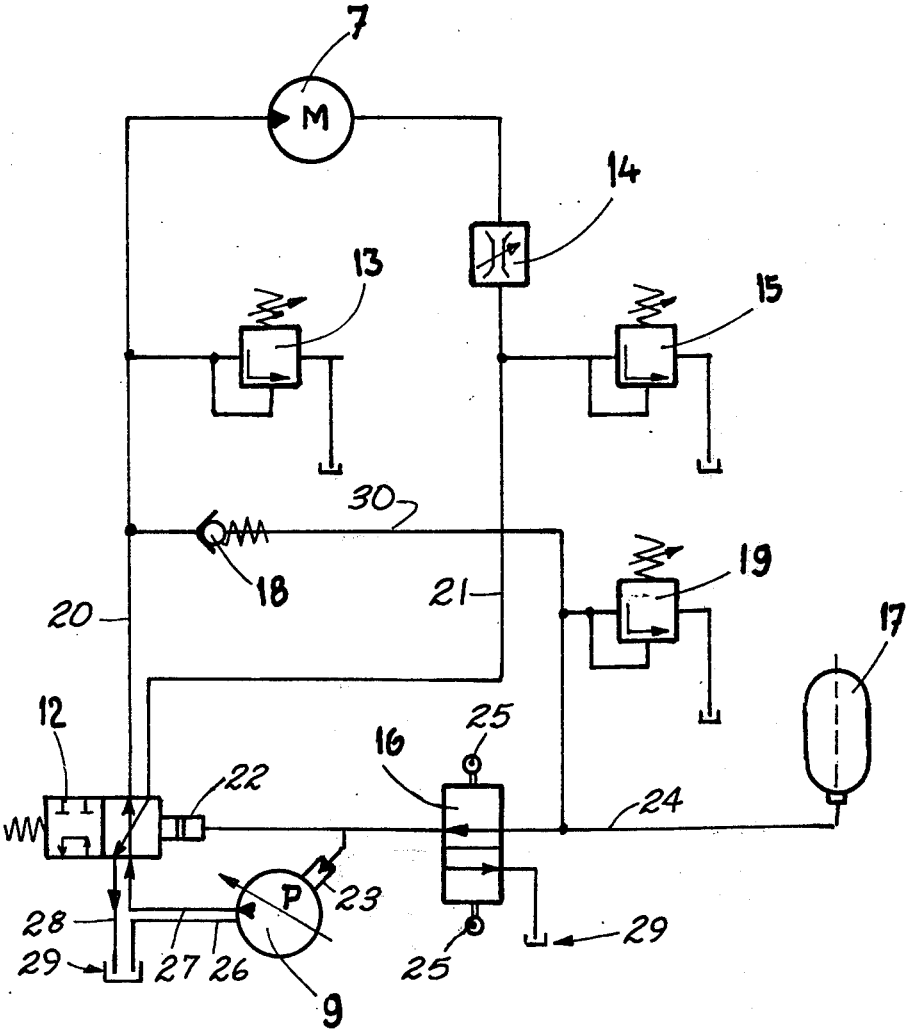
FIG. 3 shows a hydraulic diagram for the drive mechanism according to FIGS. 1 and 2.

According to FIG. 3, the hydraulic pump 9, which is constructed as an axial piston pump, operates via a path-valve 12 the hydraulic motor 7. The hydraulic pump 9 draws fluid from a storage container 29 via a pipe 26 and forces fluid via a pipe 27 to the path-valve 12. When the path-valve 12 is open, the fluid flows via the pipe 20 to the motor 7 and via the pipe 21 from the motor 7 to the path-valve 12 and from there via the pipe 28 back into the storage container 29. A pressure-limiting valve 13 is connected with the pipe 20 to the hydraulic motor 7, and a precision throttle 14 is mounted in the pipe 21 from the hydraulic motor 7. Also connected to the exit pipe 21 from motor 7 is an excess-pressure valve 15. The path-valve 12 is activated by means of a switch-valve 16. A hydraulic cylinder 22 is provided for the activation of the path-valve 12, and a hydraulic cylinder 23 is proposed for the tilting of the pump 9. Both hydraulic cylinders 22 and 23 are connected to a mutual control pipe 24 in which is arranged the switch valve 16, with an associated contact 25. A hydraulic accumulator 17 is also connected via pipe 24 to the switch-valve 16 and then to a small hydraulic cylinder 22 by means of which the delivery capacity of the hydraulic pump 9 is adjustable. The hydraulic accumulator 17 is connected with the pipe 20 to the hydraulic motor 7 via a check valve 18, and pipe 30. A pressure-limiting valve 19 is also connected to this path.

The delivery capacity of the hydraulic pump 9 is regulated by means of tilting. The setting of the desired amount of delivery is made manually or mechanically via a scale, on which the speed of rotation is set, by limiting the angle of the tilt. During the stand-still period of the rollers, the pump is tilted toward zero by means of this control so that the quantity to be delivered is decreased. After operation of the switch valve 16, the tilting movement of the hydraulic pump 9 is made, from zero up to the present amount of delivery, by means of the small hydraulic cylinder 22. After completion of the rotation of the rollers, the switch-valve 16 is operated by means of a contact 25, and the pump is tilted back to zero.

What I claim is:

1. In a drive mechanism for a pair of rollers comprising a pair of rollers operatively connected with each other;

a main drive shaft upon which is mounted one of said rollers;

a hydraulic motor engaging said shaft;

a flowrate-adjustable axial piston hydraulic pump adjusted by tilting;

means for adjusting the flowrate of said pump;

pressure fluid;

a first connecting means for connecting said hydraulic pump with said hydraulic motor;

a fluid reservoir;

a second connecting means for connecting said hydraulic motor with said fluid reservoir;

a third connecting means for connecting said fluid reservoir with said hydraulic pump;

a first switching means interposed in said first and second connecting means for controlling said hydraulic motor; and a main motor operatively connected to and driving said hydraulic pump;

the improvement comprising:

said means for adjusting the flowrate of said pump comprises a first hydraulic cylinder;

hydraulic means for actuating said first switching means;

a fourth connecting means connecting said first connecting means between said first switching means and said hydraulic motor with said fluid reservoir;

a check valve in said fourth connecting means;

a second switching means operated by means of contacts for simultaneously operating said first hydraulic cylinder and said hydraulic means, said second switching means being interposed in said fourth connecting means between said check valve and said fluid reservoir;

a hydraulic accumulator in said fourth connecting means between said check valve and said second switching means; and said first switching means being arranged so that when said motor is operating, said pressure fluid flows from said pump through said first connecting means to said motor and from said motor back to said fluid reservoir, and when said motor is stopped said pressure fluid only flows from said pump directly to said fluid reservior, said first and second connecting means being positively isolated from the fluid flow and from each other.

2. The improvement of claim 1 wherein said rollers are constructed as forging rollers having roller embossments in segmental form.

3. The improvement of claim 1 further comprising a second pressure-limiting valve interposed in said fourth connecting means between said check valve and said hydraulic accumulator.

4. The improvement of claim 1, further comprising an excess pressure valve and a precision throttle interposed in said second connecting means between said hydraulic motor and said hydraulic pump.

5. The improvement of claim 1, further comprising a first pressure-limiting valve interposed in said first connecting means between said hydraulic pump and said hydraulic motor.

* * * * *